United States Patent [19]

Mitchell

[11] Patent Number: 4,728,072

[45] Date of Patent: Mar. 1, 1988

[54] HEIGHT ADJUSTMENT APPARATUS

[75] Inventor: Terry L. Mitchell, Jenison, Mich.

[73] Assignee: Quest Product Development, Ltd., Grand Rapids, Mich.

[21] Appl. No.: 12,602

[22] Filed: Feb. 9, 1987

[51] Int. Cl.[4] ..... F16M 11/00

[52] U.S. Cl. ..... 248/406.1; 248/411

[58] Field of Search ..... 248/161, 404–406.1, 248/406.2, 411–414; 297/347; 74/89.15; 108/147, 136

[56] References Cited

U.S. PATENT DOCUMENTS

| | | | |
|---|---|---|---|
| 2,060,075 | 11/1936 | Herold | 155/93 |
| 2,529,861 | 11/1950 | Angell et al. | 248/412 X |
| 2,987,110 | 6/1961 | Cramer, Jr. | 155/93 |
| 3,164,357 | 1/1965 | Hage et al. | 248/406.2 |
| 3,633,964 | 1/1972 | Claude | 248/412 X |
| 3,923,280 | 12/1975 | Good | 248/405 |
| 4,261,540 | 4/1981 | Baker et al. | 248/406.2 |
| 4,324,382 | 4/1982 | Beukema et al. | 248/406.2 |
| 4,540,148 | 9/1985 | Jann | 248/406.2 |
| 4,613,106 | 9/1986 | Tornero | 248/405 |
| 4,627,602 | 12/1986 | Sporck | 267/182 |

FOREIGN PATENT DOCUMENTS

| | | | |
|---|---|---|---|
| 2210902 | 12/1974 | France | 248/406.2 |
| 1138172 | 12/1968 | United Kingdom | 248/412 |

*Primary Examiner*—Reinaldo P. Machado
*Assistant Examiner*—Alvin Chin-Shue
*Attorney, Agent, or Firm*—Miller, Morriss & Pappas

[57] ABSTRACT

A mechanical height adjustment apparatus having a tubular telescopic body portion powered by a spring-loaded nut on a tubular threaded shaft and in which the same spring means acts to close a friction clutch that is selectively releasable by lever means relatively displacing the clutch surfaces as desired.

3 Claims, 11 Drawing Figures

HEIGHT ADJUSTMENT APPARATUS

The present invention is directed to a new and improved height adjustment apparatus and more particularly to a mechanical height adjustment structure for chairs, tables and the like as contrasted to hydraulic, pneumatic, hydraulic-pneumatic and mechanically assisted versions for height adjustment. The invention is contained compactly in a pedestal barrel or piece located in chairs between the seat and the pedestal base mounting and in other devices as an extension of the base or pedestal.

The mechanical height adjustment apparatus of the present invention avoids hydraulic and pneumatic seals which are prone to wear, fail and leak; achieves a high adjustment range with a shorter shaft and admits of the use of a decorative tube for attachment between the support and supported member. The present invention provides added strength and stability over prior art devices for the achievement of height adjustment. The present invention makes rotation of the chair unnecessary in height adjustment. Finally, the present invention provides improved performance at lower cost and is in a cartridge or module form directly applicable to a wide variety of specific chair and adjustable mounting systems and as a substitution for existing hydraulic and pneumatic adjustment units. Further, the presently described devices will achieve four and one-half inches of height adjustment in an eight inch high cylindrical structure.

THE PRIOR ART

The U.S. Pat. Nos. 2,060,075 to Walter F. Herold and b 2,987,110 to Roy A. Cramer, Jr. exemplify rather typical threaded post types of mechanical height adjustments. The U.S. Pat. No. 3,923,280 to Wayne W. Good shows a more recent adaptation of the mechanical threaded post system, encased, however, in concentric tubes. A knob, axially provided at one end of the structure, turns the screw within the coaxial housing to lift or lower a nut provided in a concentric sleeve which is raised or lowered by the mechanism. The present apparatus, while achieving actuation in relation to threaded parts, accomplishes adjustment without manual turning of the chair, pedestal, or a screw and a nut as indicated in the prior art. The requirement for turning the chair in respect to the base while the chair, as in the U.S. Pat. No. 4,540,148 of James M. Jann, is unoccupied, to achieve an adjustment of height provides a differentiation between the present invention and devices of the past in providing selective mechanical height adjustment.

In U.S. Pat. No. 4,613,106 to Lino E. Tornero, a mechanical adjustable column is proposed in which a plurality of nuts function in stop capacities on a control core positioned "Diamond Thread Screw."

In U.S. Pat. No. 4,627,602 a Mechanical Lifting Device of Claus L. Sporck is presented and which, while providing a superficial resemblance to the present invention, in fact presents a device in which the lead screw functions only as a locking mechanism for the nuts.

Accordingly, the principal object of the present invention is to provide a relatively simple mechanical height adjustment in which rotation of the pedestal or supported platform is unnecessary while the support of the platform is secure until selectively released and selectively locked by a braking action achieved by the concentric elements in the telescopic tubular construction of the present invention.

Another object is to provide a braking structure at the heart of a tubular system wherein the threaded elements are immobilized by selected prevention of relative movement therebetween.

Other objects include simplicity of construction in a telescopic nesting of tubular elements and adaptability of the device to conventional pedestal mounted structures and in accommodation to modern clean-line design. Those knowledgeable in the art will perceive other improvements and objects as the description proceeds.

GENERAL DESCRIPTION

In the invention, a clutch, provided structurally on the axis of the telescoping tubular concentric construction, provides a selectively operable brake in prevention of relative material movement between the mounting taper and a cylindrical threaded shaft while permitting selected vertical movement of the tubular brake sleeve in respect to the threaded shaft and the shaft is spun by the lifting or depressing force on a threaded nut fixed against rotation. A sleeve or bushing between an inner tube and an outer tube maintains a close sliding fit as between the inner and outer tubes in providing stabilization of the vertical orientation of the mounting of the height adjustment between pedestal and upper surfaces supported by a mounting element. Upon release of the clutch or brake, as by an external lever selectively acting upon an axially positioned release pin (acting to separate the brake cone from the brake sleeve), the clutch is freed from restraint of the inner tube and the inner tube can then move vertically within the outer tube on the bushing sleeve and against a bias of a compression spring surrounding the stem of the brake cone and thrusting axially against the brake cone on one end and against the base or closure plate on the other end. The brake or clutch will be seen as selectively preventing and permitting relative rotational movement and lineal tubular movement of the threaded elements as a tubular shaft and nut.

The release pin extends axially through the brake cone and bears against an adjusting screw in the brake cone stem, which screw is accessible axially through the base plate and hence is capable of raising or lowering the release pin. This adjusts the lever imparted movement as desired.

The outer tube in the height adjustment structure is tapered to provide simple press mounting in, for example, a standard Morse taper in a tapered pedestal opening. The inner tube includes an upper terminal taper which may be a standard Morse taper for support of a platform having a mating taper socket to receive the taper. The upper platform may comprise a table top, chair seat, or the like requiring selected height adjustment. Variants will be appreciated juxtaposing the threaded elements and their restraints while retaining the essential function as described.

IN THE DRAWINGS

SPECIFIC DESCRIPTION

Figure 1:
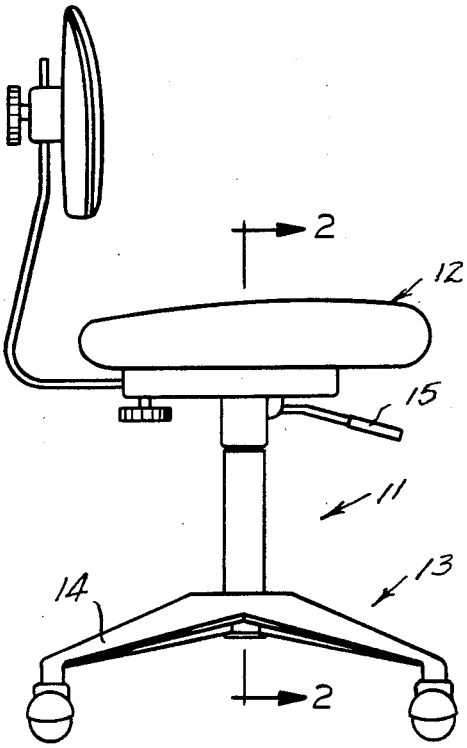
FIG. 1 is an elevational view of a chair with the height adjustment unit of the present invention mounted at the top to a chair bottom and at the bottom to a pedestal and therefore located intermediate a base and a platform for adjustment of height upon lifting the operating lever.

Referring to the drawings and with first specific reference to the FIG. 1 thereof, the height adjustment unit 11 of the present invention is shown in position between the platform 12 and the pedestal or base 13 where the platform 12 is a chair seat and the base 13 includes a plurality of legs 14. The height adjustment unit 11 permits the limited mechanical adjustment of the platform 12 in respect to the base 13, whether the usage is in a chair, table or the like. Full extension is achieved by manipulation of the release lever 15. Depression of the platform 12 is by operating the release lever 15 and depressing the platform 12 to the selected height and then releasing the lever 15 which achieves and locks or holds the selected adjustment.

Figure 2:
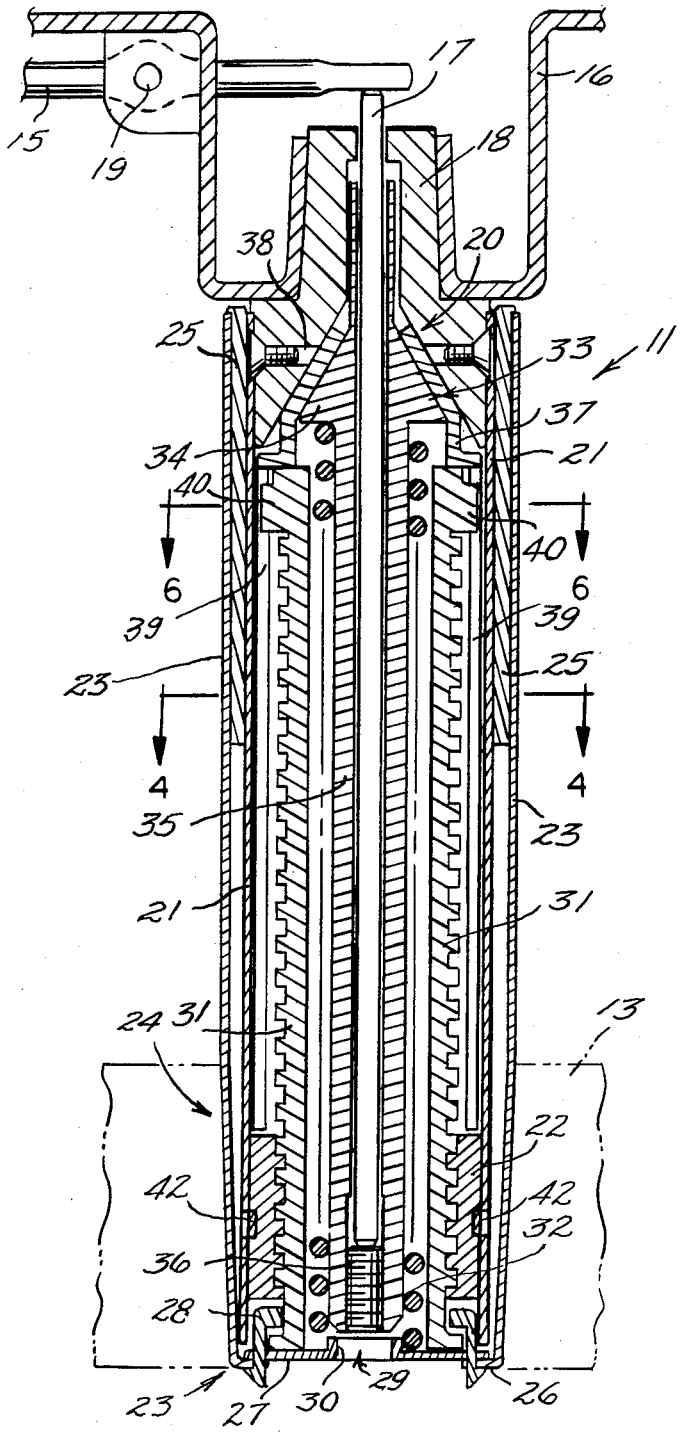
FIG. 2 is a full cross sectional elevation through the present invention as seen in FIG. 1 and taken on the line 2—2 of FIG. 1. The FIG. 2 shows the present invention in fully depressed position.
Figure 7:
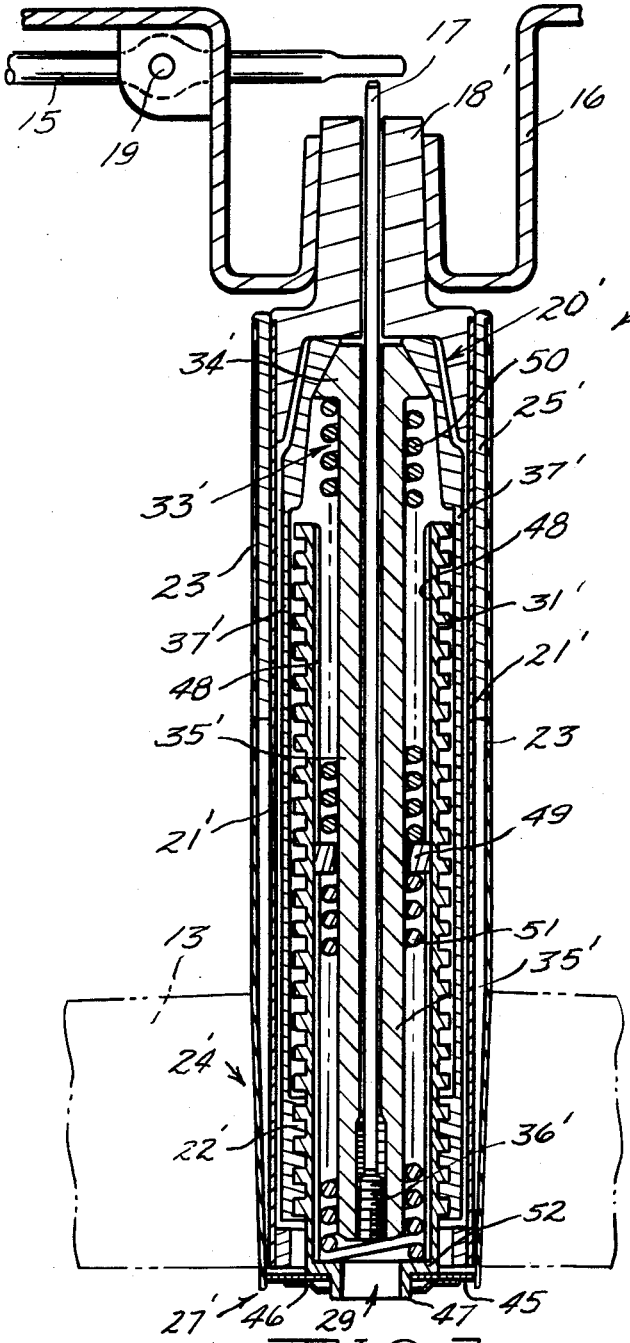
FIG. 7 is a full cross section elevation of a modified height adjustment structure in accord with the present invention taken on a plane through the longitudinal axis of the modified structure as if taken on the line 2—2 of FIG. 1 and showing the structure depressed.

In FIG. 2, the preferred embodiment of the unit 11 is revealed in a selected depressed position and indicating the release lever 15 reaching through the chassis 16 of the platform 12 to contact with the release pin 17 which extends axially upward through the mounting taper 18. As shown, a pivot pin 19 in the chassis 16 of platform 12 extends through the release lever 15 providing a tilt mechanism for selected depression of the release pin 17. As will be seen, the depression of release pin 17 unlocks the clutch or brake structure 20 and permits vertical motion adjustment in the unit 11. Release of the release lever 15 resets the brake or clutch 20 at any selected position. It will be appreciated that in chairs or movable platform structures, as shown, the chassis 16 may accommodate rotation of the platform 12 on the axis of the mounting taper 18 and may also be separately pivotal at another point. The chassis 16 may include chair or platform tilt mechanisms, as well-known in the art and where postural adjustment and spring loading of back and arms may be desired.

The upper mounting taper 18 thus provides a mounting means for connection to the platform 12 or, upon inversion of the unit 11, the pedestal 13. The mounting taper 18 is secured in the assembly of the unit 11 by connection to an inner tubular element 21. The inner tubular element 21 is also connected to a threaded nut 22. The inner tubular element 21 is in journalled linear axial telescopic movement relation to an outer tube 23, which tube 23 externally supports the unit 11 and mounts into a base or pedestal 13 as by means of a tapered portion 24 for socketing in the pedestal or base 13. A bushing-like sleeve 25 is preferred and is attached to the outer tubular sleeve 23 to maintain a close sliding fit as between the inner tubular sleeve 21 and the outer tubular sleeve 23, as shown.

The lower end 23' (adjacent the taper portion 24) of the outer tubular element 23 includes an inturned perimeter flange 26 in support of a base plate 27 and a retainer ring 28. The base plate 27 includes a central opening 29 defining, with an inner flange 30, a spring guide support and a shaft buttress.

A tubular externally threaded shaft 31 is buttressed against the base plate 27 and is secured by the retainer ring 28 from axial (upward, as shown) movement while permitting rotation on the axis of the threaded shaft 31. Internal and coaxially within the threaded tubular shaft is a compression spring 32 that thrusts against the base plate 27 guided by the inner flange 30 and the spring 32 thrusts at its other end against a brake or clutch cone 33 at the base of the conic head portion 34. The spring 32 stores energy when the platform 12 is pressed downwardly and releases energy to lift the platform 12 when the external pressure is removed. As will be seen, the spring 32 also urges the clutch cone 33 toward its engaged position. The elongate tail portion 35 of the cone 33 is sleeve-like and assists in guiding the concentrically positioned spring 32 and provides an axial journal for the internally and axially movable release pin 17. The release pin 17 rests against an adjusting screw 36 in a lower threaded portion of the tail portion 35 of the cone 33. The screw 36 is accessible through the opening 29 in the base plate 27 and is thus axially movable to adjust the extension of the release pin to offset manufacturing tolerances to operating contact with the release lever 15. When the release lever 15 presses down on the release pin 17, that forces the disengagement of the clutch 20 as the brake or clutch cone 33 is forced away from the position shown and against the pressure of spring 32.

As can be seen, the spring 32 normally urges the cone 33 against a brake sleeve 37. The brake sleeve 37 mates with the head portion 34 of the cone 33 and is shown in stop relation against the inner surface of the mounting taper 18. When acted upon by the brake cone 33 in response to the spring 32, the braking surfaces of the cone 33 are against the brake sleeve 37 and thereby stops restrains rotation between cone 33 and sleeve 37. The surface of the mounting taper 18 is shown penetrated by the fastener openings 38 and thus allows attachment of the mounting taper 18 to the inner tubular sleeve 21. The brake sleeve 37 (which may be made of plastic such as Nylon) having suitable mechanical qualities is slotted longitudinally in its tubular depending walls and the slots 39 straddle dogs 40 which extend radially from the tubular threaded shaft 31 so that the rotation of the shaft 31 can only occur with rotation of the brake sleeve 37. Depression of release pin 17 depresses the spring 32 and releases the clutch or brake structure 20 as the brake cone 33 falls away from the sleeve 37 and relieves the locking pressure impressed by the spring 32 and allows the nut 22 and attached inner tube 21 to run on the threaded shaft 31.

In the FIG. 2, the inner tubular element 21 is fully telescoped in the outer tubular element 23 by first depressing the release pin 17 and then pressing down on the platform 12 (as by sitting upon) to the desired height. To reach the position illustrated with clutch 20 disengaged, the telescoping action rotates the tubular threaded shaft 31 as the matingly threaded nut 22 is pressed downwardly by the inner sleeve 21. Secondly, upon reaching the position shown in the FIG. 2, the release pin 17 is allowed to engage to the lock position, as shown, under the urging bias of the spring 32 acting to brake or clutch the brake sleeve 37 against the taper surface of brake or clutch cone 33. This retains the height adjusting unit 11 in the selected fixed position (shown at full depression) until the release pin 17 is again depressed and the load pressure is relaxed. Then, with the clutch 20 disengaged, the loaded spring 32 urges the inner tubular element 21 upwardly to a selected upper position illustrated in FIG. 3. Locking at that position occurs when the release pin 17 allows the pressure of the spring 32 to seat the brake or clutch 20, as shown.

Figure 4:
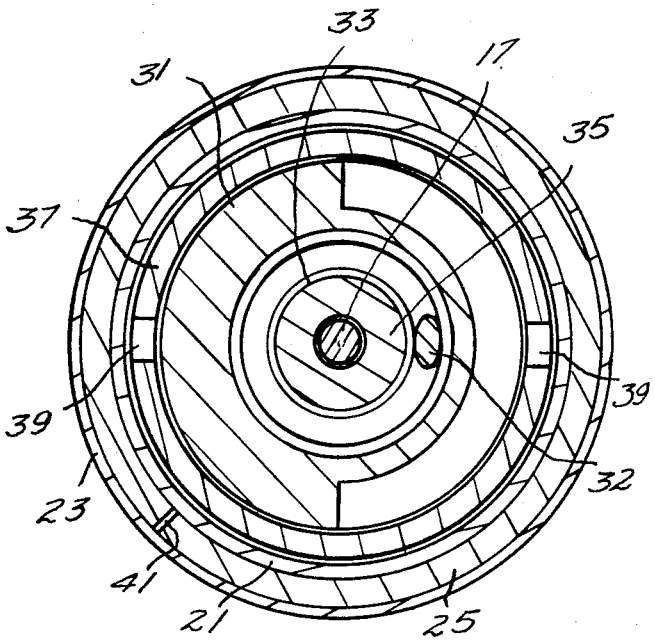
FIG. 4 is a cross section view through the axis of the height adjustment structure of the present invention and taken on line 4—4 of FIG. 2.

In FIG. 4 the concentricity of the coaxially oriented elements within the outer tube 23 can be appreciated. The release pin 17 is seen in axial orientation in the tail portion 35 of brake cone 33. The spring 32 spirals under compression in clearance relation around the tail portion 35 of the brake cone 33 and within the externally threaded tubular element shaft 31. The brake sleeve 37 is extended concentrically around the threaded shaft 31 and the longitudinal slots 39 which straddle the dogs 40 are indicated. The inner tubular element 21 is in spaced concentricity around the brake sleeve 37 and externally bears operably against the bushing 25 of the outer concentric tubular sleeve 23. The bushing 25 is keyed to the outer sleeve 23 as by the radial pin 41, by brazing, splining or other well-known means fixing the bushing 25 to the outer tubular element 23.

Figure 5:
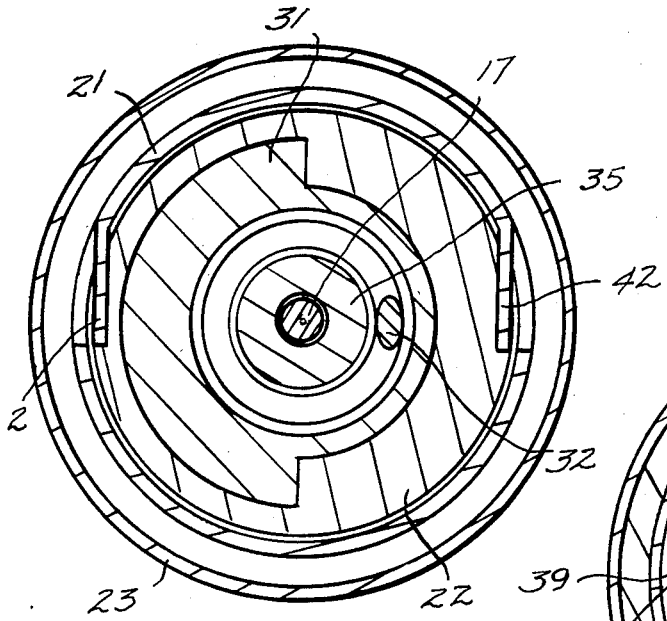
FIG. 5 is a cross section view through the axis of the height adjustment structure of the present invention and taken on line 5—5 of FIG. 3.

The FIG. 5 best illustrates the connection of the inner tubular member 21 to the threaded nut 22 by means of the tabs 42 fastened to flatted areas in the perimeter of the nut 22.

Figure 6:
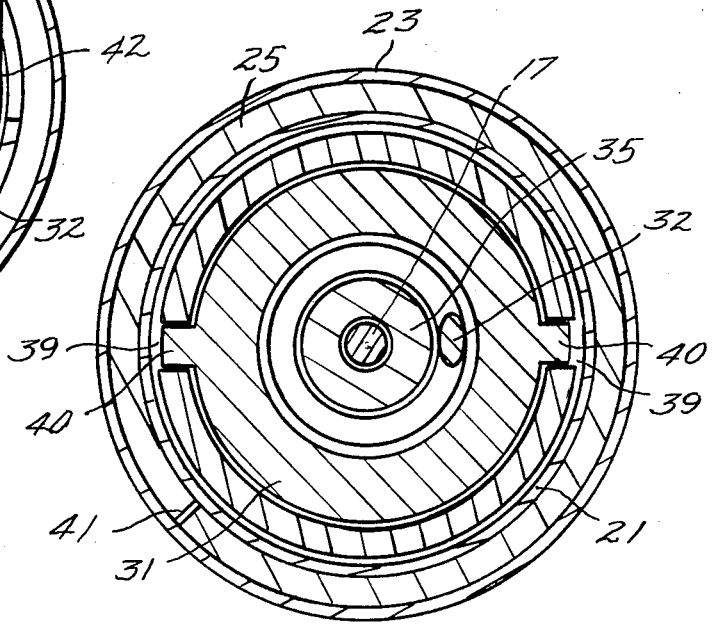
FIG. 6 is a cross section view through the axis of the height adjustment structure of the present invention and taken on line 6—6 of FIG. 2.

The FIG. 6 shows the dogs 40 extending radially from the tubular threaded shaft 31 and into the slots 39 described in the brake sleeve 37 to retain the shaft 31 from rotation unless the brake sleeve 37 also rotates. Accordingly, the braking which occurs by locking the brake sleeve 37 as against the inner tubular element 21 at the brake cone 33 secures the threaded shaft 31 against rotation and prevents axial movement of the inner tubular element 21.

The threaded relationship between the nut 22 and the tubular threaded shaft 31 is such as to produce a negative torque when an axial load is applied. In the field of power screws, this is referred to as "back-driving." When torque is positive, work must be done to advance the nut and when the torque is negative, the nut must be secured to prevent rotation. The braking in the present invention utilizes a screw specification that back-drives with the smallest negative torque and therefor requires the smallest braking force to prevent rotation. The particular thread is basically an ACME type thread. The specific thread of the tubular thread shaft 31 shown is 1.375 inch outside diameter, six threads per inch, triple start ACME, with Class 2-G fit. The internal thread of nut 22 is formed to match the mating part. The shaft 31 may be made from a machined or molded Nylon, a type of long chain synthetic polyamide having good mechanical qualities or a resin having comparable mechanical qualities.

The FIGS. 7–11, inclusive, illustrate a modified version of the preferred embodiment of the height adjustment unit 11 shown in the FIGS. 1–6, inclusive. In all respects, the function of the structure of unit 11′ parallels the function of the unit 11 and the modifications illustrate production economies and simplifications of construction while providing substantially equivalent service and for the purposes of adjusting the height of a platform 12 such as the chair bottom of FIG. 1 or a table top, for example above the base or pedestal 13.

As in the FIGS. 1–6, inclusive, the chassis 16 includes a taper mounting portion into which the mounting taper 18′ is axially inserted and through which taper the release pin 17 is axially and operably inserted. The pin 17 extends into contact with the release lever 15 which pivots on the pivot pin 19 in the chassis 16. The engagement of the pin 17 with the release lever 15 is a following contact, as previously described, and poised in upper travel by the setting of the pin 17 by the adjusting screw 36′ in the tail portion 35′ of the tubular brake cone 33′. The screw 36′ is advanced or retracted on internal threads and is accessible from the opening 29′ through base plate 27′ and through the closure ring 45 snap ring 46 and base 47 of the tubular externally threaded shaft 31′.

Figure 3:
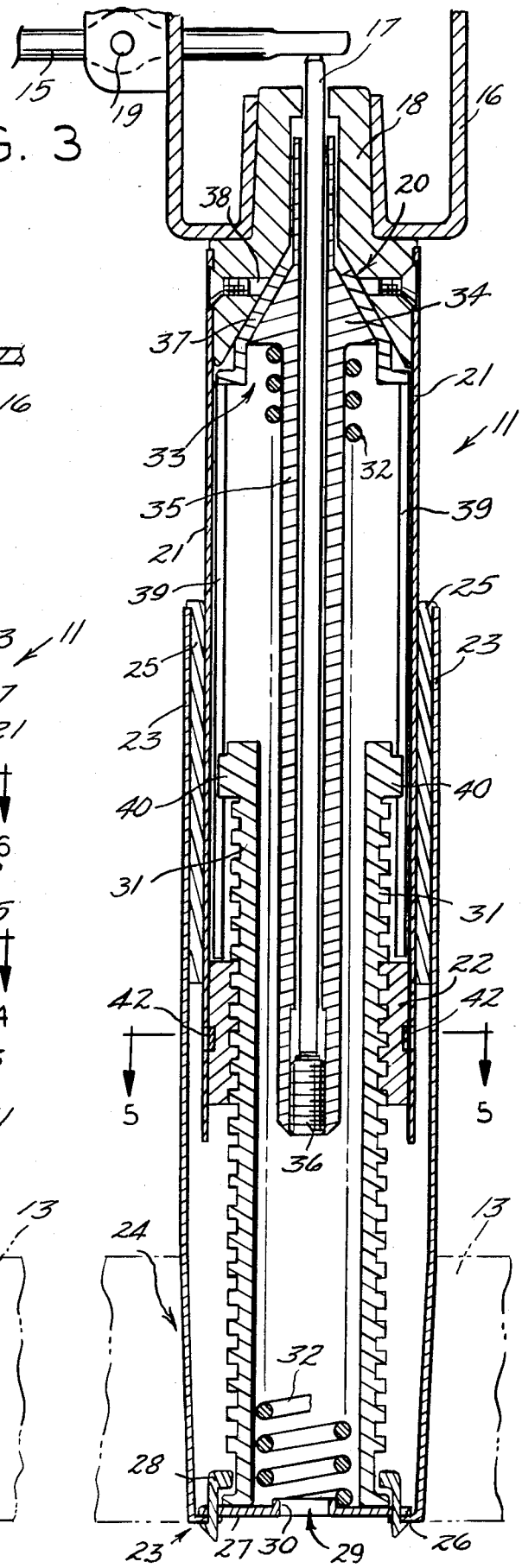
FIG. 3 is a full cross sectional elevation as in FIG. 2 and indicating the height adjustment structure at an extended position in elevation of an attached platform.

The tubular threaded shaft 31′ includes a pair of juxtaposed index slots 48 which run the length of the shaft 31′An index ring 49 is keyed to the brake cone 33′ and includes radial extensions which project, as seen, into the slots 48 thereby permitting relative vertical or axial movement of the shaft 31′ in respect to the brake cone 33′ while assuring that rotation of the cone 33′ will not occur around the axis of the shaft 31′. Compression springs 50 and 51 surround the tail portion 35′ of the cone 33′ and apply thrust to both sides of the index ring 49 and the spring 50 thrusts against the enlarged and tapered head portion 34′ of the cone 33′. Compression spring 51 at the lower side thrusts against the inner flange 52 of the tubular shaft 31′ surrounding the opening 29′. Both springs 50 and 51 store energy when the platform attached to the chassis 16 (chair bottom) is lowered as by an occupant and is prepared to release the stored energy when the load, as by an occupant, is relieved. In addition, both springs 50 and 51 act axially on the cone 33′ urging it to function as a brake element against the threaded brake sleeve element 37′. Depression of the pin 17 relaxes the brake clutch 20′ by relieving the engagement between the brake cone 33′ and brake sleeve 37′. The sleeve 37′, like the sleeve 37 in FIGS. 2 and 3, is generally tubular, may be made from a tough and durable plastic material, such as Nylon, and includes a tapered upper portion and a nut portion 22′ at the end of the sleeve 37 opposite the tapered upper portion of sleeve 37. The tapered upper portion of sleeve 37 mates with the conical head portion 34′ of the brake cone tube 33 in a clutch or brake relation. Accordingly, the nut portion 22′ rotates with the sleeve 37′ and as it does so it adjusts the elevation of the mounting taper 18 and the chassis 16 and platform 12. Thus, the threaded shaft 31′ is fixed in position and the nut 22′ turns on the shaft 31′ and this raises or lowers the unit 11′. The inner tubular element 21′ follows the movement of the brake sleeve 37′ in telescopic manner in the outer tube 23' and guided lineally by the cylindrical bushing 25 providing axial journalling for the moving inner tube 21'.

Figure 8:
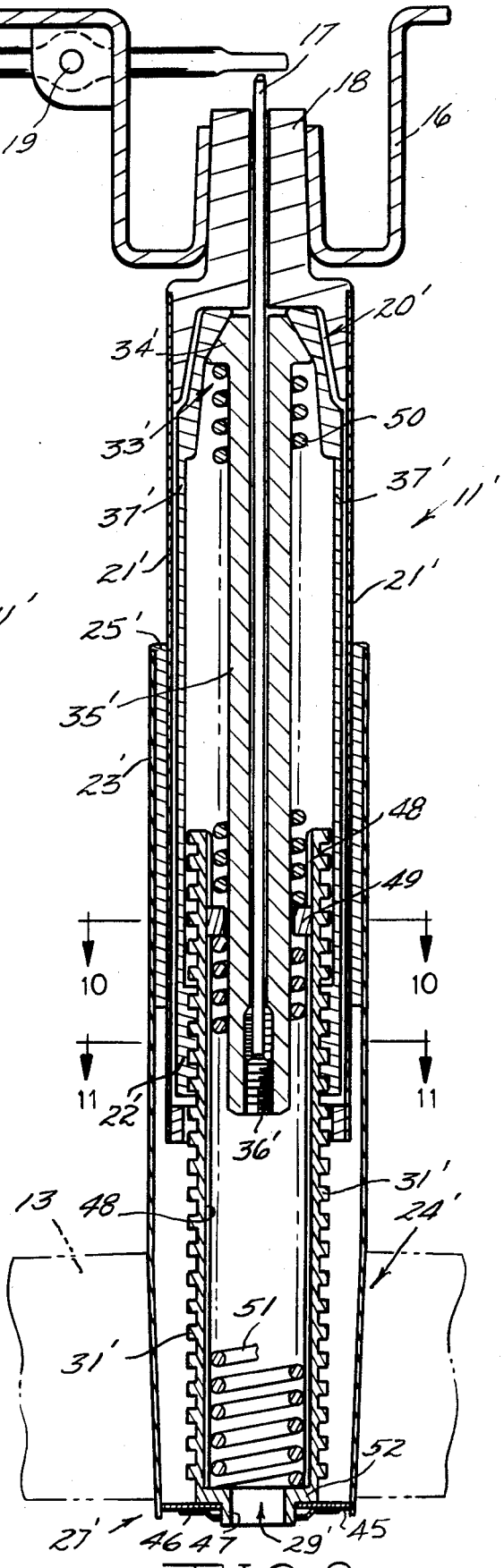
FIG. 8 is a cross section elevation view as in the FIG. 7 and indicating the height adjustment structure of the present invention in extended condition.

In the FIG. 8, the unit 11 is shown in an elevated position illustrating the selected movement achieving height adjustment by the described mechanics.

Figure 9:
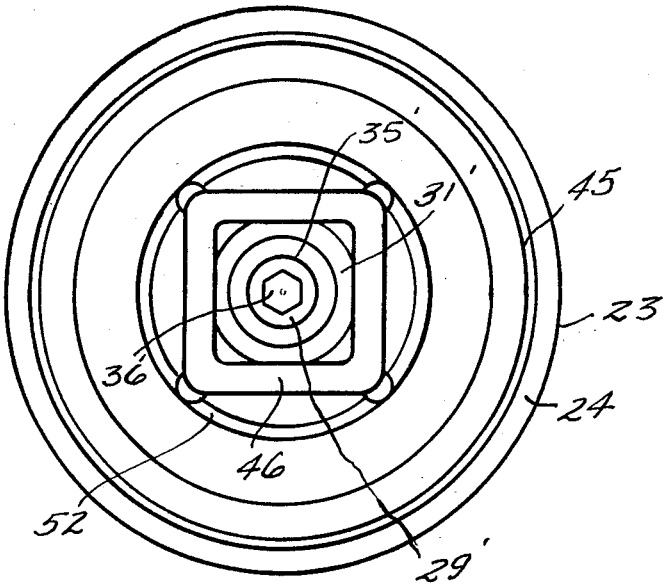
FIG. 9 is a bottom plan view of the structure shown in FIGS. 7 and 8.
Figure 10:
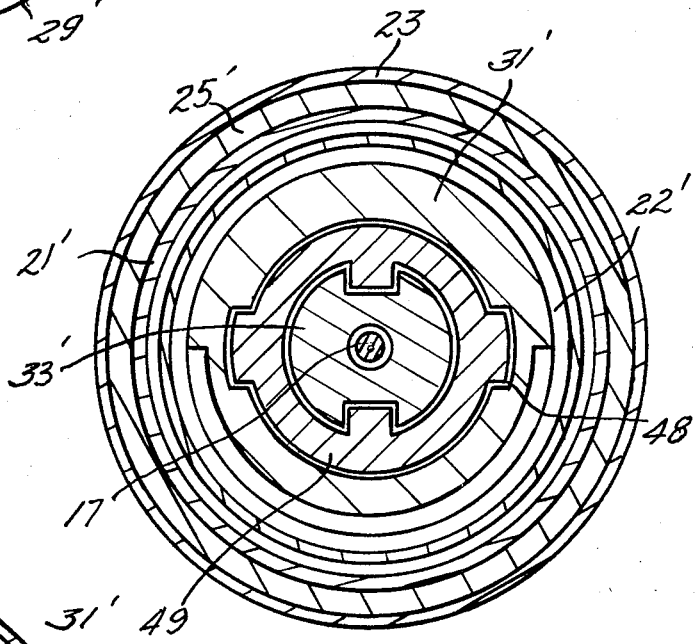
FIG. 10 is a cross section view through the axis of the height adjustment structure of the present invention and taken on line 10—10 of FIG. 8.
Figure 11:
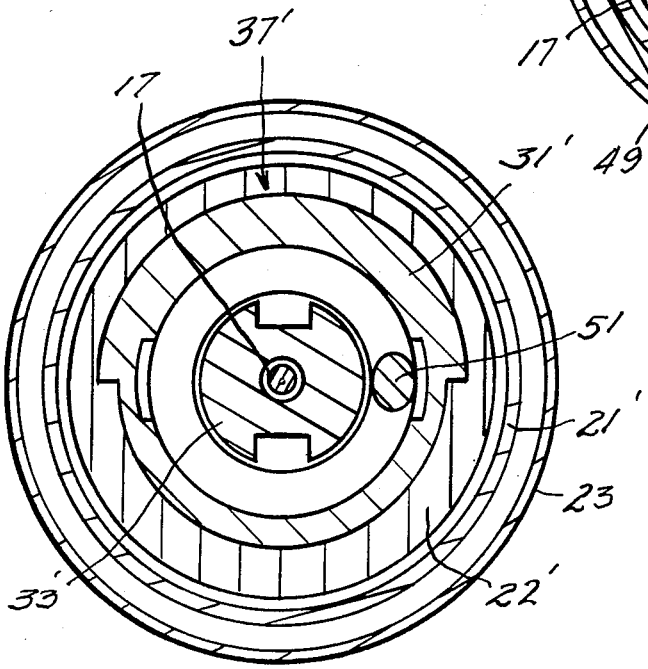
FIG. 11 is a cross section view through the axis of the height adjustment structure of the present invention and raken on line 11—11 of the FIG. 8.

Referring to FIGS. 9, 10 and 11, these selected cross sections are helpful in clarifying the construction. The FIG. 9 best illustrates the snap ring 46 retaining the closure ring 45 against the inner lower flange 52 of the threaded shaft 31'. The brake pin adjusting screw 36' is seen and its hexagonal head is accessible through the opening 29' in the base of structure 11'. The outer tube 23 with its lower taper portion 24 is also visible and provides a good mounting connection for the unit 11' to the pedestal 13 as earlier described.

In FIG. 10, taken on section line 10—10, the index ring 49 is keyed externally to the threaded shaft 31' and internally to the brake cone 33'. This results in a spline-like control preventing relative rotation as between the brake cone 33' and the threaded shaft 31' while allowing relative axial displacement as between these elements. In this manner, where the brake 20' is locked between the brake cone head 34' and the tubular brake sleeve 37', no relative movement occurs between the outer tubular element 23' and the inner tubular element 21'. However, depression of the control pin 17 against springs 50 and 51 results in release of the lock-up and the threaded portion 22' of brake sleeve element 37' can spin on the threads to selected position on the shaft 31'.

In FIG. 11 the cross section 11—11 illuminates the situation beneath the section 10—10 of FIG. 8 through the axis of the unit 11. The outer tubular element 23' is seen externally concentric around the inner tubular element 21' in telescoped axial relation. The tubular brake sleeve 33 with its threaded nut portion 22' threadably engages the externally threaded shaft 31' in a fit previously described. The spring 51 is seen internal of the threaded shaft 31 and axially surrounds the brake cone 33'. The keyways serving the index rings 49 in the shaft 31' and the brake cone 33' can now be seen beneath the index ring 49 shown best in FIG. 10.

In operation, the units 11 and 11' serve as a replacement or retrofit height adjustment structure for existing installations and it is adaptable to new chair and table manufacture because it requires simple attachment fixturing, as shown. The extensive usage of plastic parts in the concentric construction makes the unit very inexpensive. The concentric telescoping steel tube arrangement between inner and outer tubular elements provides adequate strength and sturdiness. The arrangement compliments modern clean-line design features seen in furnishings and the purely mechanical functioning avoids such problems as seal wear, failure, and leakage incidental to hydraulic and pneumatic buffered devices. The units 11 and 11' function easily and smoothly. Since the units 11 and 11' are mechanical, there is no seat drop noted in the prior art comprised air cushioned structures.

Having thus described my height adjustment structure, including a preferred embodiment and one close variant, others skilled in the art will recognize improvements, modifications and changes. Such improvements, modifications and changes are intended to be included in the spirit of the described invention, limited only by the scope of the hereinafter appended claims.

I claim:

1. A mechanical height adjustment apparatus comprising:

a threaded tubular shaft element;

an outer tube connected to said shaft at one end;

a nut meshed with the threads on said threaded shaft and one of said nut and said shaft movable vertically and axially;

an inner tube in coaxial lineal journalled relation to said outer tube and telescopically movable axially in said outer tube in accord with the vertically movable of said nut and shaft;

a spring-loaded tapered friction brake lock having a mating brake sleeve and brake cone in one end of said height adjusting apparatus and said brake sleeve operably connected to said vertically movable of said shaft and said nut thereby bearing against said inner tube on one side and against said spring-loaded brake cone on the other side, said brake cone applying spring pressure to said brake sleeve and said inner tube in prevention of vertical movement; and a release lever selectively engageable with said brake lock releasing spring pressure on said brake sleeve permitting relative telescoping vertical movement of said inner tube and said outer tube attending rotation and vertical displacement of one of said shaft and said nut.

2. A tubular telescopic mechanical height adjustment apparatus useable between a base element and a structure positioned above said base and selectively adjustably supported by said height adjusting apparatus comprising:

a threaded tubular shaft element;

an outer tube in axial support of said shaft at one end and secured to said shaft at one end in prevention of said shaft from axial displacement while permitting said shaft to rotate on its axis;

a nut meshed with the threads on said threaded shaft and movable vertically on the axis of said shaft in accord with relative rotation of said tubular shaft;

an inner tube axially concentric and in lineal journalled relation to said outer tube and telescopically movable axially in said outer tube, said inner tube fixedly connected to said nut and moving with said nut as said nut moves in respect to said shaft;

a spring-loaded tapered friction brake lock means concentrically provided in one end of said height adjusting apparatus including a brake sleeve keyed to said shaft, and said shaft engaged driveably against said nut and said shaft displaceable by said nut and said sleeve bearing against said inner tube on one side and against a spring-loaded brake cone on the other side, said brake cone applying spring pressure to said brake sleeve and thence against said inner tube in prevention of vertical movement in a selected position; and a lock release lever concentrically and selectively engageable with said brake cone to displace said brake cone from locking engagement against the spring bias thereby permitting relative telescoping vertical movement of said inner tube and said outer tube with attendant rotation of said threaded shaft.

3. A tubular telescopic mechanical height adjustment apparatus useable between a base element and a structure positioned above said base and selectively adjustably supported by said height adjusting apparatus comprising:

a threaded tubular shaft element;

an outer tube in axial support of said shaft at one end and secured to said shaft at one end in prevention of said shaft from axial displacement while permitting said shaft to rotate on its axis;

a nut meshed with the threads on said threaded shaft and movable vertically on the axis of said shaft in accord with relative rotation of said tubular shaft;

an inner tube axially concentric and in lineal journalled relation to said outer tube and telescopically movable axially in said outer tube, said inner tube moving with said nut as said nut moves in respect to said shaft;

a spring-loaded tapered friction brake lock means concentrically provided in one end of said height adjusting apparatus including a brake sleeve driveably connected to said nut, and said nut engaged driveably against said shaft and said brake sleeve displaceable thereby and in bearing relation against said inner tube on one side and against a spring-loaded brake cone on the other side, said brake cone applying spring pressure to said brake sleeve and thence against said inner tube in prevention of vertical movement in a selected position;

spring means surrounding said brake cone and loading said brake lock;

an index ring keyring said tubular shaft to said brake cone; and a lock release lever concentrically and selectively engageable with said brake cone to selectively displace said brake cone from locking engagement against the spring bias thereby permitting relative telescoping vertical movement of said inner tube and said outer tube with attendant rotation of said threaded shaft.

* * * * *